US011459680B2

(12) United States Patent
Nakayama et al.

(10) Patent No.: US 11,459,680 B2
(45) Date of Patent: Oct. 4, 2022

(54) SEWING DEVICE

(71) Applicant: HONDA MOTOR CO., LTD., Tokyo (JP)

(72) Inventors: Kazuma Nakayama, Tochigi-ken (JP); Masakazu Adachi, Tochigi-ken (JP); Tohru Takamura, Tochigi-ken (JP)

(73) Assignee: HONDA MOTOR CO., LTD., Tokyo (JP)

( * ) Notice: Subject to any disclaimer, the term of this patent is extended or adjusted under 35 U.S.C. 154(b) by 116 days.

(21) Appl. No.: 17/124,543

(22) Filed: Dec. 17, 2020

(65) Prior Publication Data

US 2021/0198824 A1 Jul. 1, 2021

(30) Foreign Application Priority Data

Dec. 25, 2019 (JP) ..... JP2019-233793

(51) Int. Cl.
*D05B 39/00* (2006.01)
*D05B 73/04* (2006.01)
*D05B 57/00* (2006.01)

(52) U.S. Cl.
CPC ..... *D05B 39/00* (2013.01); *D05B 57/00* (2013.01); *D05B 73/04* (2013.01)

(58) Field of Classification Search
CPC ..... D05B 39/00; D05B 57/00; D05B 73/04; D05B 21/00; D05B 23/006; D05B 31/00
See application file for complete search history.

(56) References Cited

U.S. PATENT DOCUMENTS 4,957,054 A * 9/1990 Sakuma ..... A41H 42/00 112/63
5,419,268 A * 5/1995 Fyler ..... D05B 23/00 112/470.14
5,915,317 A * 6/1999 Thrash ..... D05B 23/00 112/155
5,988,085 A * 11/1999 Martz ..... D05B 39/00 112/475.08
6,129,031 A * 10/2000 Sarh ..... D05B 25/00 901/41
7,076,856 B2 * 7/2006 Sarh ..... B25B 11/005 29/796
7,954,440 B2 * 6/2011 Joern ..... B29C 70/382 112/470.13

FOREIGN PATENT DOCUMENTS

WO 2019/187599 10/2019

* cited by examiner

*Primary Examiner* — Nathan E Durham
(74) *Attorney, Agent, or Firm* — Amin, Turocy & Watson, LLP

(57) ABSTRACT

A sewing device includes: a plurality of actuators; and a plurality of seating bodies that are provided in an attachable/detachable manner to the individual actuators to seat on certain regions of an object-to-be-sewn. The sewing device further includes a restraining jig. Due to the restraining jig collectively restraining the plurality of seating bodies provided to the actuators, the plurality of seating bodies can withdraw from the actuators.

9 Claims, 10 Drawing Sheets

SEWING DEVICE

CROSS-REFERENCE TO RELATED APPLICATION

This application is based upon and claims the benefit of priority from Japanese Patent Application No. 2019-233793 filed on Dec. 25, 2019, the contents of which are incorporated herein by reference.

BACKGROUND OF THE INVENTION

Field of the Invention

The present invention relates to a sewing device for forming a seam in an object-to-be-sewn by a needle and a looper.

Description of the Related Art

Sometimes, in order to create a high-quality feeling in a vehicle interior of an automobile, a skin material that has been cut or molded to match a shape of an instrument panel undergoes stitch pattern sewing (is provided with a seam). Recently, it has been attempted to perform this sewing by a sewing device. There is known as this kind of sewing device one disclosed by the applicant of the present application in International Publication No. 2019/187599.

Specifically, this sewing device comprises: a sewing mechanism such as a sewing machine; a sewing robot having its tip arm provided with the sewing mechanism; and a plurality of seating bodies ("workpiece holding jigs" referred to in International Publication No. 2019/187599) that seat in a withdrawable manner on certain regions of an inner surface of the instrument panel, that is, a rear face of a surface facing the vehicle interior, of the instrument panel to hold by suction the certain regions. The seating bodies are separately provided to piston rods of raising/lowering actuators, for example, air cylinders, or the like, and seat on the certain regions as the piston rods ascend. The shape of the instrument panel is maintained due to this seating.

In order for sewing to be continuously performed, the sewing mechanism moves sequentially along the instrument panel. When there is a state of the seating body having seated on a place where sewing is to be performed, of the instrument panel, the needle or looper interferes with the seating body. In order to avoid this interference, a configuration is adopted whereby, at the place where sewing is to be performed, the piston rod positioned at the place descends so that the seating body is withdrawn from the instrument panel. Then, when the sewing mechanism passes after sewing finishing, the piston rod re-ascends, and the seating body re-seats on the inner surface of the instrument panel. That is, the seating body re-supports the instrument panel.

SUMMARY OF THE INVENTION

It is assumed that after sewing has been performed on the instrument panel of a certain vehicle type, sewing will be performed on the instrument panel of another vehicle type.

Since the instrument panels have shapes and sizes that differ according to the vehicle type, it is required that at such a time, the seating body is exchanged for one matching the shape and size of the instrument panel.

As described above, there exist a plurality of the seating bodies. Hence, it is complicated for the individual seating bodies to be sequentially exchanged, and, moreover, a burden for a worker. Moreover, since a long time is required for exchange, sewing work has to be suspended over a long time. To that extent, sewing efficiency falls.

A main object of the present invention is to provide a sewing device that enables withdrawal or fitting of a plurality of seating bodies to actuators to be efficiently performed.

According to an embodiment of the present invention, there is provided a sewing device that forms a seam in an object-to-be-sewn by a needle configured to penetrate through or withdraw from the object-to-be-sewn due to repeating reciprocating movement, and a looper that faces the needle with the object-to-be-sewn therebetween and is housed within a post bed, the sewing device comprising:

- a plurality of actuators;
- a plurality of seating bodies provided in an attachable/detachable manner to the individual actuators, and configured to seat on or separate from certain regions of the object-to-be-sewn; and
- a restraining jig configured to collectively restrain the plurality of seating bodies, and collectively release restraint of the plurality of seating bodies, wherein
- due to the restraining jig collectively restraining the plurality of seating bodies provided to the actuators, the plurality of seating bodies are allowed to withdraw from the actuators as the actuators operate in a direction of separating from the object-to-be-sewn, and
- when the restraining jig collectively releases restraint of the plurality of seating bodies, the seating bodies become displaceable as the actuators operate in a direction of seating on or separating from the object-to-be-sewn.

According to the present invention, it is possible for a plurality of seating bodies to be collectively restrained by one restraining jig. Conversely to this, it is possible too for restraint of the plurality of seating bodies of the restraining jig to be collectively released. Therefore, the plurality of seating bodies can be collectively delivered from the restraining jig to actuators, or in a reverse direction to that, that is, from the actuators to the restraining jig. Hence, the plurality of seating bodies can be collectively exchanged.

That is, in the present invention, there is no need for work individually exchanging individual seating bodies to be performed. Therefore, exchange work is simplified, so the burden of the worker decreases. Moreover, since the seating bodies can be exchanged in a short time, a suspension time of the sewing work shortens. Accordingly, it can be avoided that sewing efficiency falls.

The above and other objects, features, and advantages of the present invention will become more apparent from the following description when taken in conjunction with the accompanying drawings, in which a preferred embodiment of the present invention is shown by way of illustrative example.

DESCRIPTION OF THE PREFERRED EMBODIMENTS

Figure 1:
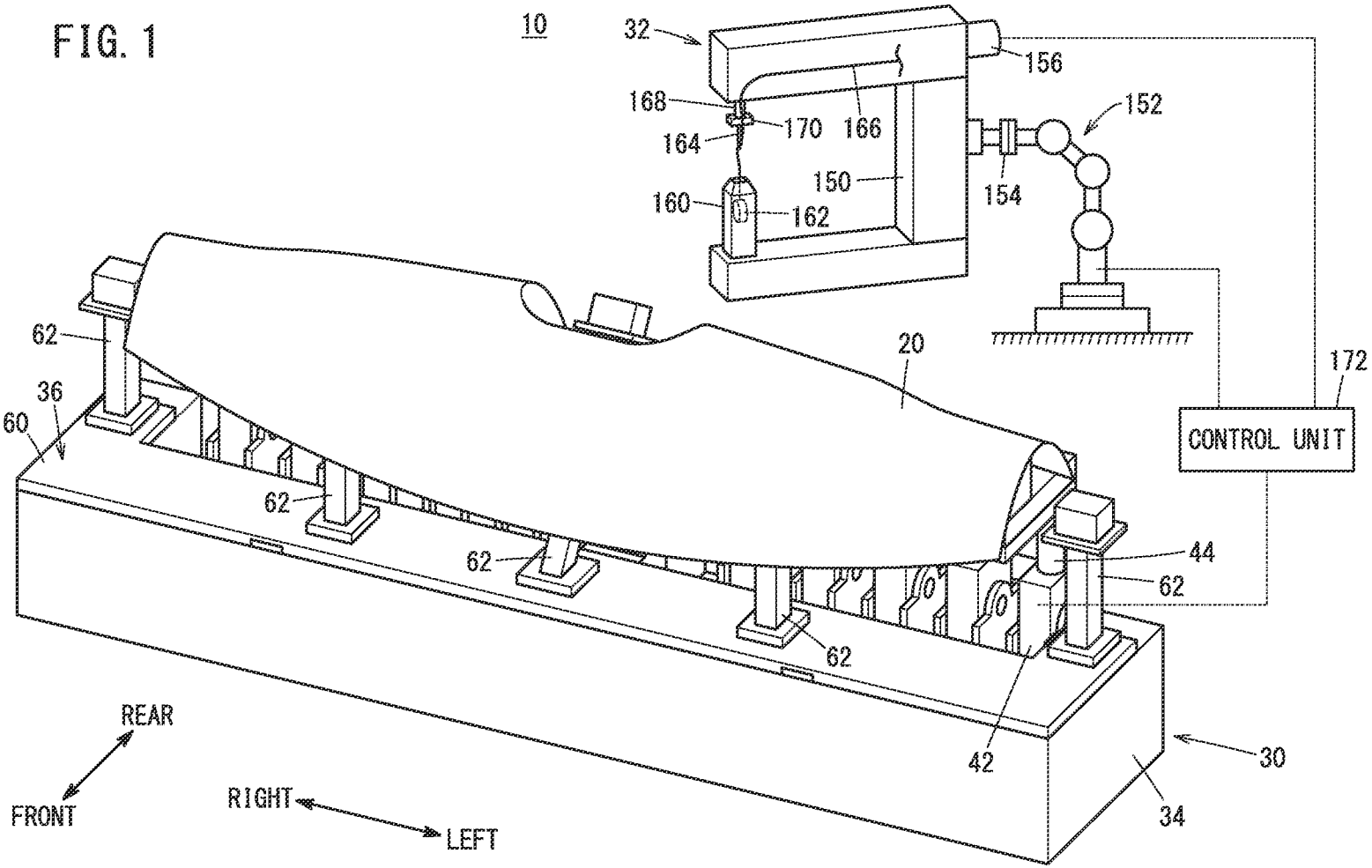
FIG. 1 is a schematic overall perspective view of a sewing device according to an embodiment of the present invention.

A preferred embodiment of a sewing device according to the present invention will be presented and described in detail below with reference to the accompanying drawings, in relation to an exchange method of seating bodies performed by the sewing device. Note that "front" hereafter will indicate a side where a holding mechanism 30 shown in FIG. 1 is arranged, while "rear" will indicate a side where a sewing robot 152 is arranged. Moreover, a "width direction" is a horizontal direction orthogonal to a "front-rear direction". Moreover, a left-hand side and a right-hand side of a worker at a time when he or she visually recognizes the holding mechanism 30 side (a front side) from the sewing robot 152 side (a rear side), are respectively defined as "left" and "right".

FIG. 1 is a schematic overall perspective view of a sewing device 10 according to the present embodiment. This sewing device 10 is for performing sewing on an instrument panel 20 being an object-to-be-sewn. Roughly describing the instrument panel 20 with reference to FIG. 6, this instrument panel 20 is configured as a hollow laminated object having a skin material 24 laminated on a base material 22. High polymers such as olefin-based elastomers may be cited as preferred examples of each of materials of the base material 22 and the skin material 24.

A seam 26 being a stitch pattern is formed in the instrument panel 20 along a sewing line L on an outer surface of the skin material 24. At this time, the instrument panel 20 is supported by seating bodies 54 from an inner surface side of the base material 22, and this will be mentioned later.

Returning to FIG. 1, the sewing device 10 comprises: the holding mechanism 30 that holds the instrument panel 20; and a sewing mechanism 32 for forming the seam 26. First, the holding mechanism 30 of these will be described.

Figure 2:
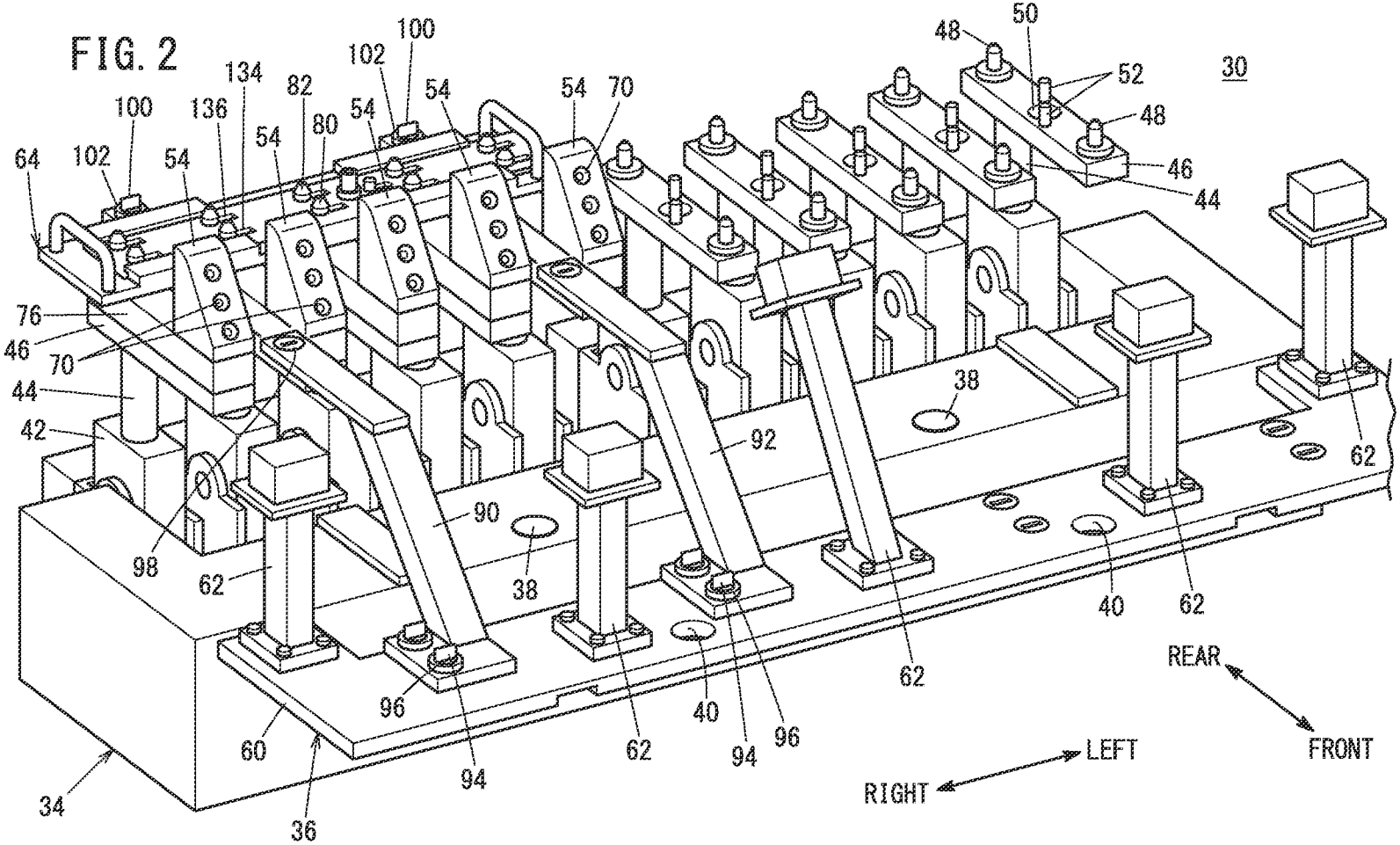
FIG. 2 is a principal parts perspective view showing a state where a holding mechanism configuring the sewing device has been separated into a base and a holding board.

The holding mechanism 30 includes: a base 34; and a holding board 36 positioned and fixed on the base 34. As shown in FIG. 2, it is possible for the base 34 and the holding board 36 to be separated from each other. That is, the base 34 is provided with two first pallet clamps 38, while the holding board 36 is provided with first embedding blocks 40 at respective positions corresponding to the first pallet clamps 38. When the first pallet clamp 38 enters the first embedding block 40, the first embedding block 40 is locked under action of a pressurized fluid such as compressed air or hydraulic oil. As a result, it becomes difficult for the first pallet clamp 38 to withdraw from the first embedding block 40. The above configuration and operation are publicly known, hence detailed descriptions thereof will be omitted.

A rear portion of the base 34 is provided with a plurality of (for example, 10) raising/lowering cylinders 42 as actuators, in such a manner that the raising/lowering cylinders 42 are arranged in a line along the width direction. The raising/lowering cylinder 42 is configured including a raising/lowering rod 44 as an advancing/retracting member that ascends or descends. The raising/lowering rod 44 performs a raising/lowering operation along a vertical direction.

Figure 3:
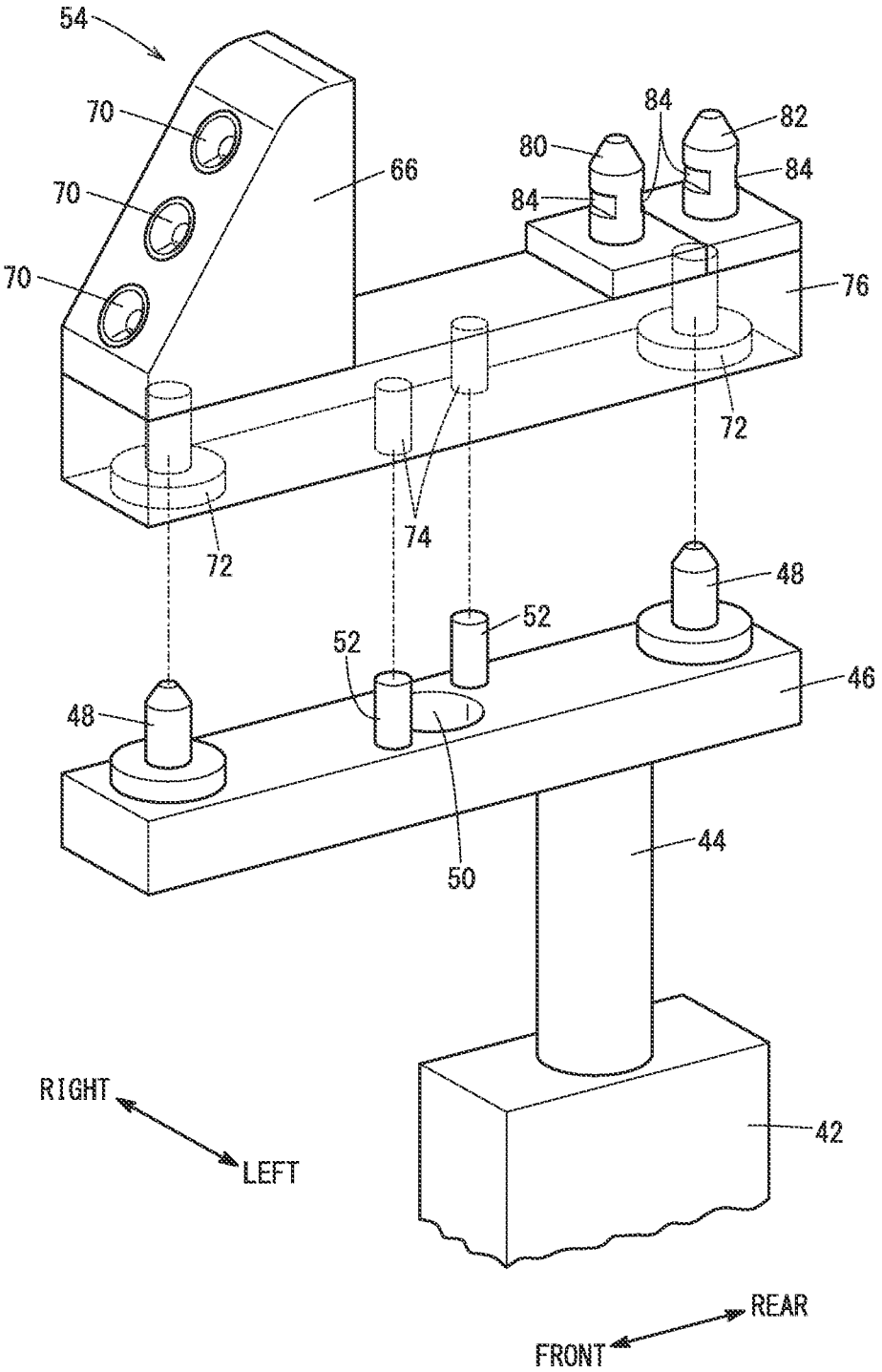
FIG. 3 is a schematic perspective view of a tip of an actuator, and a seating body configuring the sewing device.

Tips of the raising/lowering rods 44 are each provided with a placing block 46 shown in FIG. 3. That is, the placing block 46 is displaced so as to ascend/descend integrally with the raising/lowering operation of the raising/lowering rod 44. The placing blocks 46 each have two second pallet clamps 48 installed therein in such a manner that the second pallet clamps 48 are arranged in a line along the front-rear direction sandwiching a through-hole 50. Moreover, two positioning pins 52 (protrusions) are uprightly arranged in a vicinity of the through-hole 50. The seating body 54 is placed on the placing block 46, as will be mentioned later.

On the other hand, the holding board 36 includes: a base portion 60 placed on an upper surface of the base 34 to be supported by the base 34; and support column portions 62 uprightly arranged on the base portion 60. The base portion 60, which is a substantially U-shaped flat plate, is provided with the two first embedding blocks 40 as described above. The support column portions 62 serve to support the instrument panel 20 in conjunction with the seating bodies 54, and are provided in five places of the base portion 60, that is, end portions to left and right in the width direction, a central portion, a portion between the left end portion and the central portion, and a portion between the right end portion and the central portion, of the base portion 60, for example.

Figure 5:
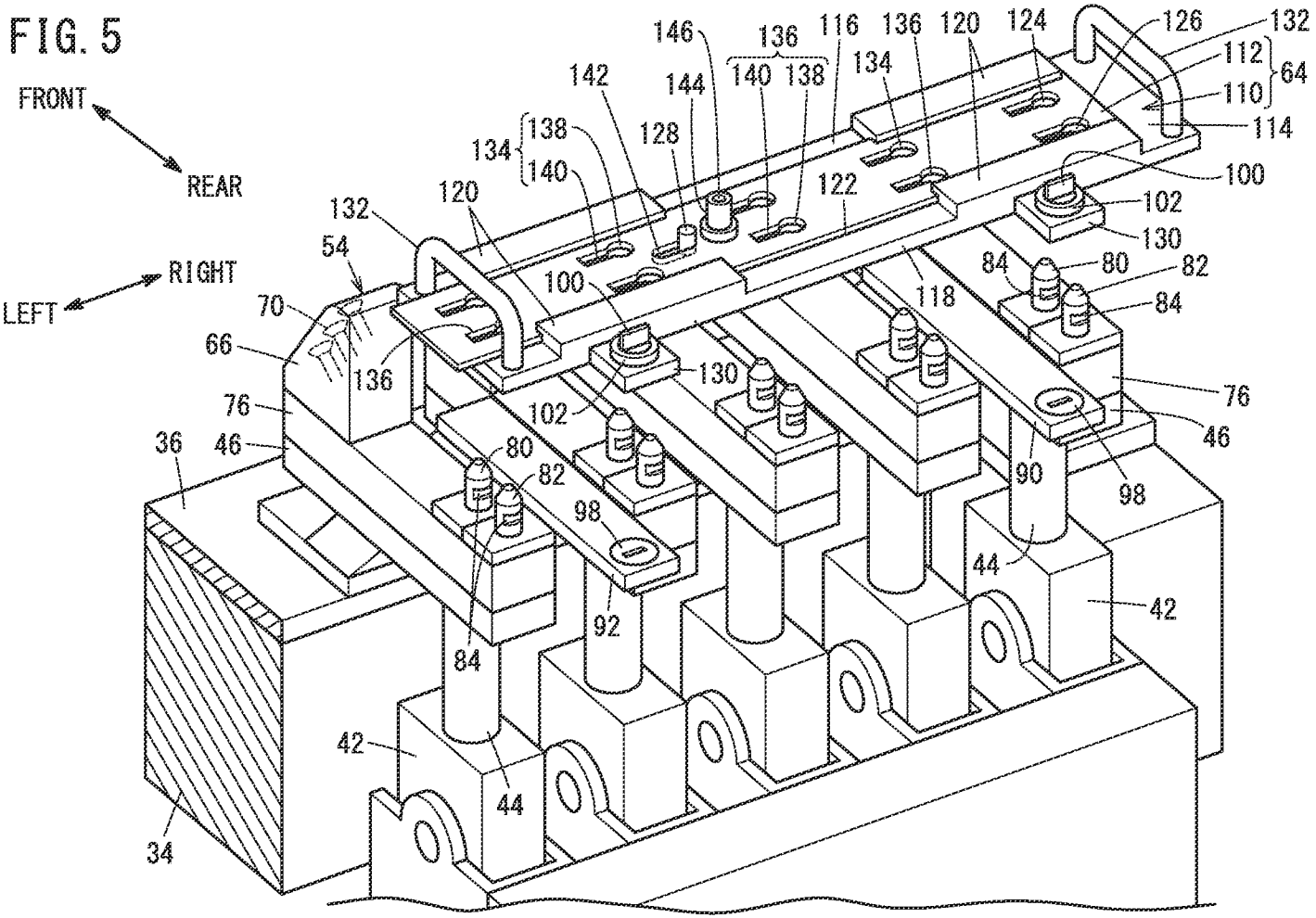
FIG. 5 is a principal parts perspective view showing a state where a restraining jig has been disposed at the rear of the seating bodies.

The holding mechanism 30 further includes the seating bodies 54 that are restrained by the raising/lowering rods 44, or a restraining jig 64 shown in FIG. 5. More specifically, the seating body 54 includes: a main body portion 66 (refer to FIG. 3); and a plurality of suction pads 70 provided to the main body portion 66. By the main body portions 66 abutting (seating) on the inner surface of the base material 22 of the instrument panel 20, the instrument panel 20 is held in such a manner that its shape is maintained. Moreover, the suction pads 70 are connected to an unillustrated suction pump. When the suction pump is energized, the suction pads 70 attach by suction to the inner surface of the base material 22. As a result, the instrument panel 20 is positioned and fixed on the seating bodies 54.

Second embedding blocks 72 are provided in a lower surface of the main body portion 66 at positions corresponding to the second pallet clamps 48. In a similar manner to as described above, the second embedding block 72 is locked under action of a pressurized fluid such as compressed air or hydraulic oil, whereby it becomes difficult for the second pallet clamp 48 to withdraw from the second embedding block 72. Moreover, positioning holes 74 as recesses are formed in the lower surface of the main body portion 66 at positions corresponding to the positioning pins 52. By the positioning pins 52 entering the positioning holes 74, the seating body 54 is prevented from undergoing positional misalignment.

Figure 4:
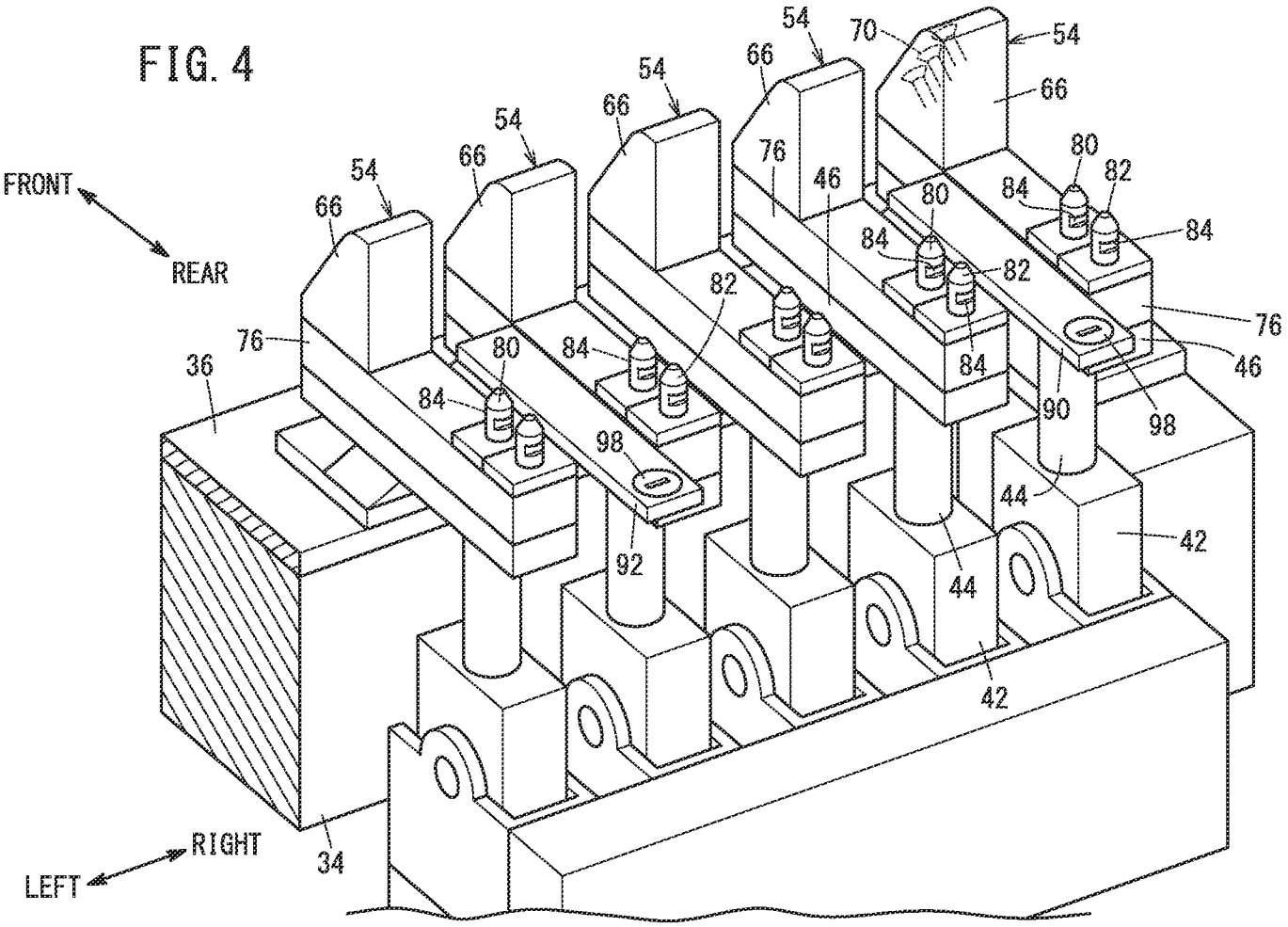
FIG. 4 is a principal parts perspective view of a rear portion of the holding mechanism.

As shown in FIG. 4, the seating body 54 further includes a projecting end portion 76 that projects in a rearward direction from the main body portion 66. A front-side pin 80 and a rear-side pin 82 (both projections) are uprightly arranged in a rear portion of the projecting end portion 76, so as to be aligned along the front-rear direction. Engaging grooves 84 (grooves) as first engaging portions are respectively formed in places facing frontwards and rearwards, of side peripheral walls of these front-side pin 80 and rear-side pin 82. A phase difference between the two engaging grooves 84 is substantially 180°.

When exchanging the seating bodies 54, a first arm member 90 and a second arm member 92 (both supports) shown in FIG. 2, and the restraining jig 64 shown in FIG. 5, are employed. The first arm member 90 and the second arm member 92 of these are each provided in an attachable/detachable manner to the base portion 60 via a first rotary lock as a first attaching/detaching mechanism. That is, the base portion 60 is provided with an unillustrated female joint configuring the first rotary lock. Moreover, lower ends (one ends) of the first arm member 90 and the second arm member 92 are each provided with a male joint 96 configuring the first rotary lock, and having a cock handle 94. By the worker inserting, in the female joint, a joint portion provided on a lower surface of the male joint 96, and then gripping the cock handle 94 to rotate the cock handle 94, the first rotary lock enters a locked state. That is, the first arm member 90 and the second arm member 92 are coupled to the base portion 60. In order to release locking or coupling, the cock handle 94 need only be rotated in a reverse direction to the direction during coupling.

As shown in FIG. 4, upper ends (other ends) of the first arm member 90 and the second arm member 92 are each provided with a female joint 98 configuring a second rotary lock as a second attaching/detaching mechanism. On the other hand, the restraining jig 64 is provided with a male joint 102 configuring the second rotary lock, and having a cock handle 100 (refer to FIG. 5). By the worker inserting, in the female joint 98, a joint portion provided on a lower surface of the male joint 102, and then gripping the cock handle 100 to rotate the cock handle 100, the second rotary lock enters a locked state. That is, the restraining jig 64 is coupled to the first arm member 90 and the second arm member 92. At this time, the restraining jig 64 is supported by the base portion 60, via the first arm member 90 and the second arm member 92. In order to release locking or coupling, the cock handle 100 need only be rotated in a reverse direction to the direction during coupling.

The restraining jig 64, which is a long body having a pedestal 110 and a sliding plate 112 (a sliding member) shown in FIG. 5, is configured in an attitude that its extension direction coincides with the width direction of the base 34. The pedestal 110 of these includes: a bottom wall portion 114; and a front wall portion 116 and a rear wall portion 118 that rise substantially perpendicularly from the bottom wall portion 114. Furthermore, the front wall portion 116 and the rear wall portion 118 are provided with retaining portions 120. The pedestal 110 has a shallow-bottomed box shape due to a sliding groove 122 being formed by the bottom wall portion 114, the front wall portion 116, the rear wall portion 118, and the retaining portions 120. A left end and a right end of the sliding groove 122 are both open ends.

The bottom wall portion 114 has formed therein a front-side insertion hole 124 and a rear-side insertion hole 126 (both insertion holes) that penetrate along a thickness direction (a vertical direction). The front-side pin 80 and the rear-side pin 82 are respectively inserted through the front-side insertion hole 124 and the rear-side insertion hole 126. The number of each of the front-side insertion holes 124 and the rear-side insertion holes 126 is set according to the number of the seating bodies 54 to be restrained by the restraining jig 64. In the present embodiment, five of the 10 seating bodies 54 are held by one restraining jig 64, so the number of each of the front-side insertion holes 124 and the rear-side insertion holes 126 is five. In the bottom wall portion 114, an unillustrated pin hole is further formed, and a stopper pin 128 is uprightly arranged at a place separate from the pin hole.

Moreover, the front wall portion 116 and the rear wall portion 118 are provided with a total of four retaining portions 120. The retaining portions 120 prevent the sliding plate 112 from falling out of the sliding groove 122.

Furthermore, two flange portions 130 are formed on the rear wall portion 118 so as to project orthogonally to an extension direction of the rear wall portion 118, and in a rearward direction. The male joint 102 having the cock handle 100 is provided to the flange portion 130. Moreover, arched handles 132 to be gripped by the worker are fitted to the pedestal 110 so as to extend along the front-rear direction.

The sliding plate 112 is housed in a slidable manner in the sliding groove 122. This sliding plate 112 has front-side slits 134 and rear-side slits 136 (all notches) formed therein in numbers corresponding to the numbers of the front-side insertion holes 124 and the rear-side insertion holes 126. These front-side slits 134 and rear-side slits 136 each include: a circular portion 138 as a through-hole portion; and a narrowed portion 140 linked to the circular portion 138. These circular portion 138 and narrowed portion 140 each penetrate along a thickness direction of the sliding plate 112.

An inner diameter of the circular portion 138 is set larger than diameters of the front-side pin 80 and the rear-side pin 82. On the other hand, the narrowed portion 140 extends along the extension directions of the pedestal 110 and sliding plate 112, that is, along the width direction of the base 34. Moreover, a length of the narrowed portion 140 in the front-rear direction orthogonal to an extension direction is set smaller than the inner diameter of the circular portion 138. That is, the front-side slit 134 and the rear-side slit 136 are narrowed from the circular portion 138 to the narrowed portion 140. In other words, an opening dimension of the circular portion 138 is larger than the length of the narrowed portion 140 in the front-rear direction. Note that the length of the narrowed portion 140 in the front-rear direction is smaller than the diameters of the front-side pin 80 and the rear-side pin 82. Therefore, a front-side inner wall portion and a rear-side inner wall portion of the narrowed portion 140 function as second engaging portions as will be mentioned later.

The sliding plate 112 has further formed therein a pin insertion slit 142 through which the stopper pin 128 is inserted. The pin insertion slit 142 is formed substantially midway in the front-rear direction of the sliding plate 112, and extends along the width direction of the base 34. Moreover, a columnar handle 144 (a gripping portion) of hexagonal columnar shape is uprightly arranged in a vicinity of the pin insertion slit 142. The columnar handle 144 has formed therein a pin insertion hole 146 that extends along the vertical direction. The pin insertion hole 146 and the pin hole overlap when the front-side pin 80 and the rear-side pin 82 are positioned at a left end of the narrowed portion 140. At this time, a coupling pin 148 (refer to FIG. 10) is inserted in the pin insertion hole 146, and a tip of the coupling pin 148 enters the pin hole.

As will be mentioned later, the first arm member 90, the second arm member 92, and the restraining jig 64 are provided when exchanging the seating bodies 54, and are removed when performing sewing.

As shown in FIG. 1, the sewing mechanism 32 comprises a casing 150 having a recumbent U shape in side view. A tip arm 154 of the sewing robot 152 is coupled to this casing 150. Moreover, the casing 150 is provided with a sewing motor 156.

Figure 6:
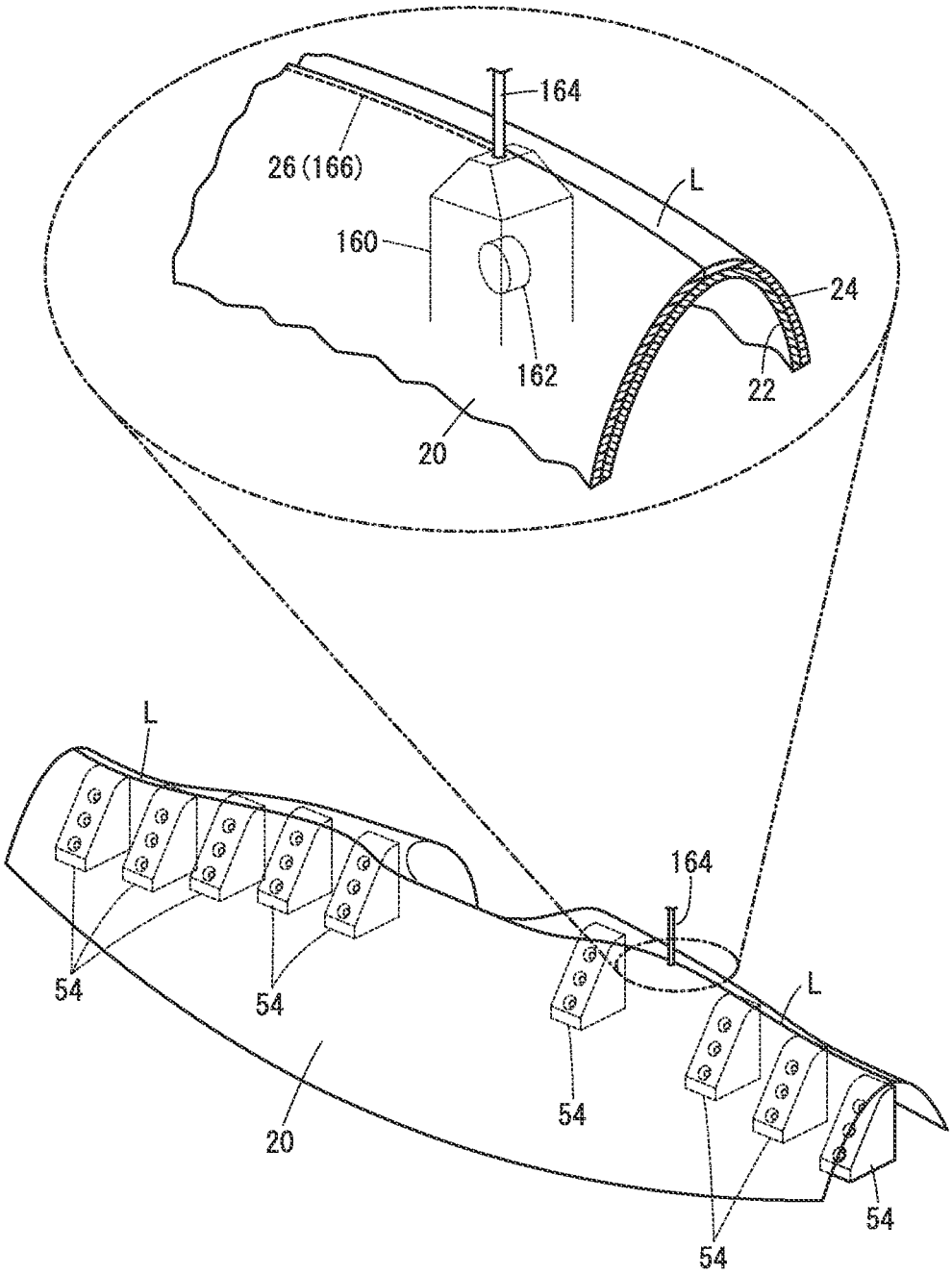
FIG. 6 is a principal parts perspective view showing a state where sewing is being performed with an object-to-be-sewn being held by the seating bodies.

As shown in FIG. 6, the casing 150 is provided with a post bed 160. This post bed 160 houses a looper 162 which is rotationally driven by the sewing motor 156. The looper 162 is coupled to the sewing motor 156 inside the casing 150 via a timing belt, gear train, and so on, but this configuration is publicly known, so illustration, description, and so on, thereof will be omitted.

The looper 162 has a hook-like hooking claw, although detailed illustration thereof will be omitted. A thread 166, which has been passed through a needle eye of a sewing machine needle 164 (a needle), is hooked on this hooking claw. Now, an upper end surface of the post bed 160 is open, and it is thus possible for the sewing machine needle 164 to enter or retract from an inside of the post bed 160.

The casing 150 is provided with a reciprocating shaft 168 that performs reciprocating movement. This reciprocating shaft 168 is provided with the sewing machine needle 164, via a needle holder 170. The sewing machine needle 164 performs reciprocating movement integrally with the reciprocating shaft 168, as a rotating shaft of the sewing motor 156 rotates. This configuration too is publicly known, so detailed illustration and description thereof will be omitted. Note that the sewing machine needle 164 faces the looper 162 within the post bed 160.

In the above configuration, the holding mechanism 30, the sewing mechanism 32, and the sewing robot 152 are electrically connected to a control unit 172 being a controlling means. The sewing robot 152 moves the sewing mechanism 32 at a constant speed along the sewing line L being a sewing direction, under controlling action of the control unit 172. Moreover, at this time, an attitude of the casing 150 is changed to match a shape of a sewing position of the instrument panel 20. As a result, an attitude of the sewing mechanism 32 is adjusted in such a manner that the sewing machine needle 164 will be substantially perpendicular to the sewing position of the instrument panel 20 (the sewing line L). The control unit 172 further performs energizing or de-energizing of the sewing motor 156.

The sewing device 10 according to the present embodiment, which is basically configured as above, will next have its operational advantages described in relation to an exchange method of the seating bodies 54.

When performing sewing on the instrument panel 20, initially, as shown in FIGS. 1 and 6, the instrument panel 20 is supported by the support column portions 62 of the holding board 36. In addition, each of the raising/lowering rods 44 is set to an appropriate height position, and the main body portions 66 of the seating bodies 54 are seated on the inner surface of the base material 22 of the instrument panel 20. The above results in the instrument panel 20 being supported by the holding board 36, that is, the holding mechanism 30.

Next, the suction pump is energized. Accordingly, suction is performed via the suction pads 70, whereby the suction pads 70 attach by suction to the inner surface of the base material 22. That is, the instrument panel 20 is positioned and fixed on the seating bodies 54.

Next, the sewing robot 152 appropriately operates under controlling action of the control unit 172, and the tip arm 154 of the sewing robot 152 is brought close to the instrument panel 20. As a result, as shown in FIG. 6, the instrument panel 20 is located at a position sandwiched by the post bed 160 (the looper 162) and the sewing machine needle 164. At this time point, the looper 162 and the sewing machine needle 164 face each other via the instrument panel 20.

As shown in FIG. 6, when the post bed 160 and the sewing machine needle 164 have reached a place where sewing is to be performed, the raising/lowering cylinder 42 lowers the raising/lowering rod 44 under controlling action of the control unit 172, and separates the seating body 54 from the instrument panel 20. A clearance occurring between the seating body 54 and the instrument panel 20 due to this separation is entered by the post bed 160. The sewing device 10 is thus configured in such a manner that the seating bodies 54 are sequentially retracted depending on a position of the sewing mechanism 32, and sewing is thereby performed with the post bed 160 disposed on the inner surface of the instrument panel 20. Note that suction from the suction pads 70 of the seating body 54 to be retracted is stopped in advance of retraction.

The base material 22 configuring the instrument panel 20 is thick, and exhibits comparatively high rigidity. Therefore, even when the seating body 54 is separated from part of the instrument panel 20, it is avoided that deformation of the instrument panel 20 such as warping occurs at the place.

Next, the control unit 172 energizes the sewing motor 156. As a result, the reciprocating shaft 168 performs upward/downward reciprocating movement. Naturally, the sewing machine needle 164 held by the needle holder 170 also performs upward/downward reciprocating movement integrally with the reciprocating shaft 168. On the other hand, the looper 162 rotates. The looper 162 makes one rotation in the course of the sewing machine needle 164 making one back-and-forth movement.

The sewing machine needle 164 is inserted from an outer surface side of the skin material 24 in the course of advancing along an outward route downwardly from a highest point (a top dead point). Then, when the sewing machine needle 164 reaches a lowest point (a bottom dead point), its tip projects from a lower end surface of the base material 22, and enters a hollow inside of the post bed 160. As a result, the thread 166 penetrates the instrument panel 20. At this time, the hooking claw of the looper 162 has reached the top dead point, so the thread 166 that has penetrated the instrument panel 20 is caught by the hooking claw.

In this state, the sewing machine needle 164 begins to advance along a return route from the bottom dead point toward the top dead point. As the sewing machine needle 164 ascends and the looper 162 rotates, the thread 166 is pulled into the inside of the post bed 160. The pulled thread 166 forms a loop portion on an inner surface side of the base material 22.

While the sewing machine needle 164 performs reciprocating movement, the control unit 172 appropriately operates arms of the sewing robot 152 or changes its attitude. As a result, as shown in FIG. 6, the sewing machine needle 164 and the post bed 160 sequentially move along the sewing line L. As a result, the seam 26 being a stitch pattern, is formed. Note that the sewing machine needle 164 that enters the inside of the post bed 160 is passed through the loop portion formed during the previous reciprocating movement.

When, after sewing has been performed on the instrument panel 20 of a certain vehicle type, sewing is performed on the instrument panel of another vehicle type, it is assumed that shape, size, and so on, of the seating bodies 54 will not handle the instrument panel of the other vehicle type. In such a case, the seating bodies 54 are exchanged.

The worker first raises all of the raising/lowering rods 44 to the highest point. As a result, height positions of all of the placing blocks 46 match. The placing blocks 46 and the seating bodies 54 are arranged in a line along the width direction of the base 34.

The worker next fits the first arm member 90 and the second arm member 92 (refer to FIG. 2) to the base portion 60 configuring the holding board 36. In order to do this, the joint portions of the male joints 96 provided to the first arm member 90 and the second arm member 92 are inserted in the female joints provided in the base portion 60. Then, the cock handles 94 are rotated approximately 90°, and the female joints and male joints 96 are set to a locked state. As a result, lower ends of the first arm member 90 and the second arm member 92 are coupled to the base portion 60 via the first rotary locks.

Figure 7:
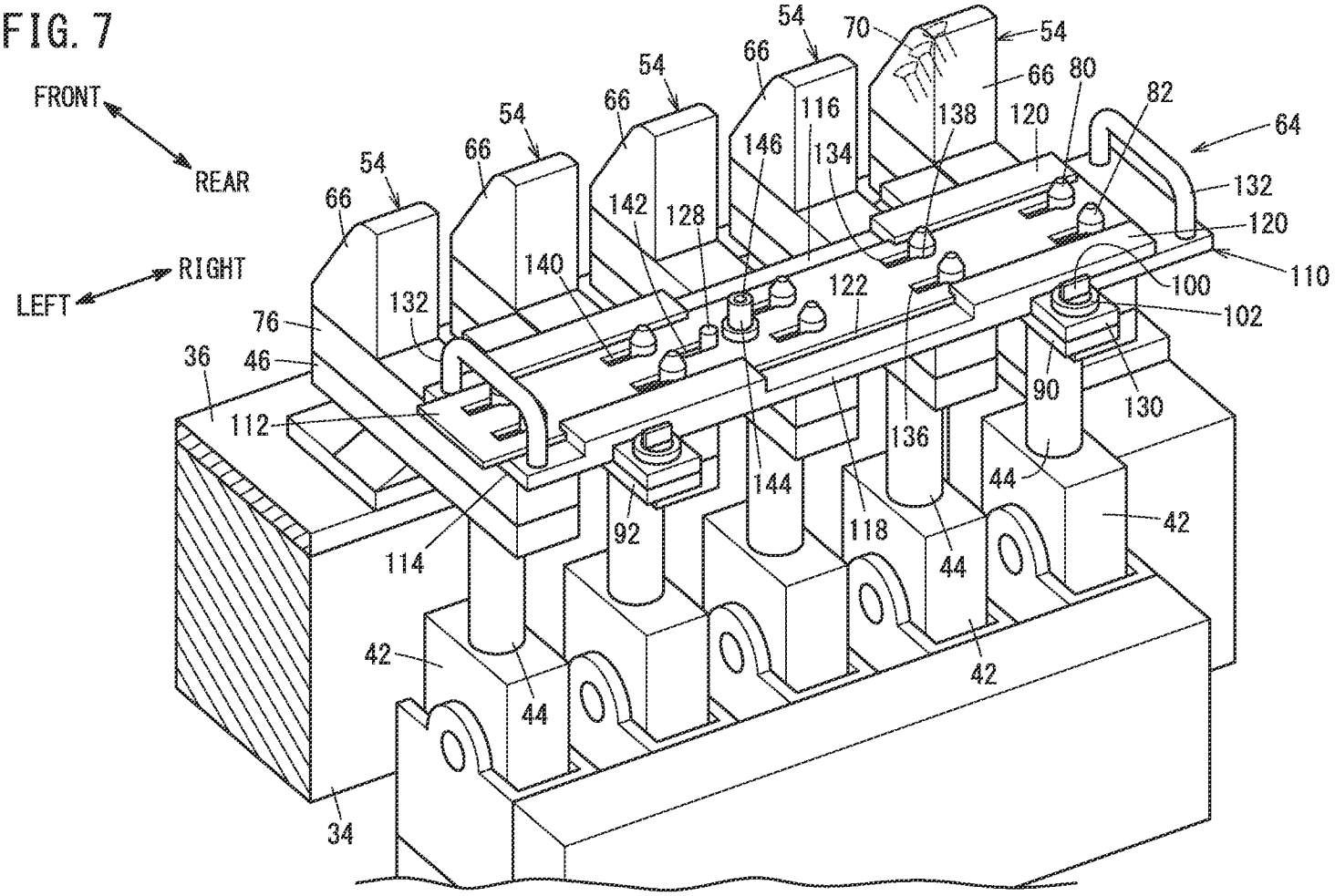
FIG. 7 is a principal parts perspective view showing a state where the restraining jig has been coupled to upper ends of the first arm member and the second arm member being supports, following from FIG. 5.

The worker next moves to a rear portion side of the holding mechanism 30, and positions the restraining jig 64 shown in FIG. 5 on upper ends of the first arm member 90 and the second arm member 92. Specifically, the worker grips the arched handles 132 to perform alignment of the female joints 98 provided to the upper ends of the first arm member 90 and the second arm member 92, and the male joints 102 provided to the restraining jig 64. Then, as shown in FIG. 7, the joint portions of the male joints 102 are inserted in the female joints 98.

At this time point, the front-side insertion holes 124 and the rear-side insertion holes 126 formed in the pedestal 110 are respectively overlapped by the circular portions 138 of the front-side slits 134 and the rear-side slits 136 formed in the sliding plate 112. The front-side pins 80 and the rear-side pins 82 provided to the projecting end portions 76 of the seating bodies 54 respectively enter from the front-side insertion holes 124 and the rear-side insertion holes 126, and are exposed from the circular portions 138 immediately thereabove. That is, the front-side pins 80 are passed through the circular portions 138 of the front-side slits 134 via the front-side insertion holes 124, and, similarly, the rear-side pins 82 are passed through the circular portions 138 of the rear-side slits 136 via the rear-side insertion holes 126.

Figure 8:
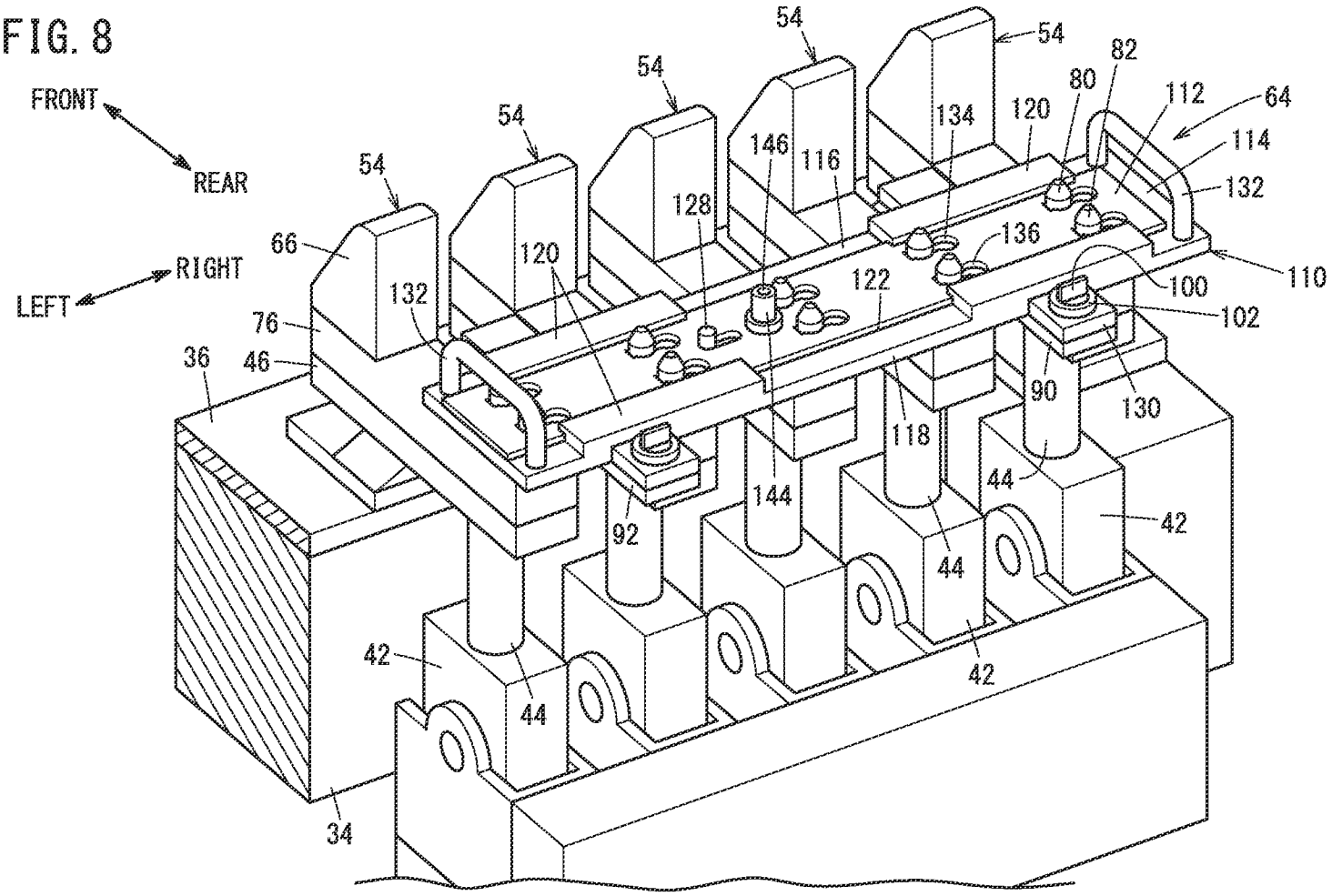
FIG. 8 is a principal parts perspective view showing a state where a sliding plate has been slid, following from FIG. 7.

The worker next grips the columnar handle 144, and imparts a force moving the sliding plate 112 to the right. As a result, the sliding plate 112 slides rightwards in the sliding groove 122. Thus, due to the columnar handle 144 being provided, it becomes easy for the sliding plate 112 to be slid. Then, as a result of this sliding, as shown in FIG. 8, the front-side pins 80 and the rear-side pins 82 move relatively into the narrowed portions 140 of the front-side slits 134 and the rear-side slits 136.

Figure 9:
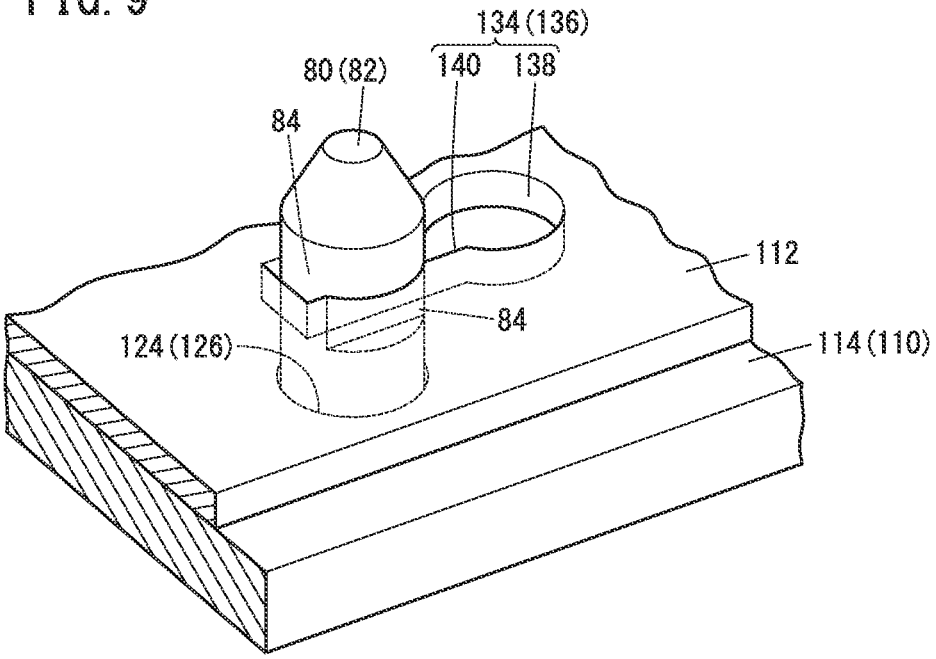
FIG. 9 is an enlarged perspective view enlarging a state where an inner wall portion of a notch has been entered by a pin being a projection, in FIG. 8.

Now, the length of the narrowed portion 140 in the front-rear direction is smaller than the diameters of the front-side pin 80 and the rear-side pin 82, as described above. Moreover, the front-side pin 80 and the rear-side pin 82 each have two engaging grooves 84 formed therein. Hence, as shown in FIG. 9, the front-side inner wall portion and the rear-side inner wall portion of the narrowed portion 140 enter the engaging grooves 84. That is, two places of the sliding plate 112 are engaged per one individual front-side pin 80 or rear-side pin 82. Ultimately, in the case of the illustrated example, four engaging places are formed between one seating body 54 and the sliding plate 112. Note that the total number of engaging places formed between all of the seating bodies 54 (all of the front-side pins 80 and rear-side pins 82) and the sliding plate 112 is 20. The above engagement results in all of the seating bodies 54 being restrained in the restraining jig 64.

The sliding plate 112 stops by the stopper pin 128 abutting on a leftward inner wall portion of the pin insertion slit 142. At this time point, positions of the pin insertion hole 146 formed in the columnar handle 144 and the pin hole formed in the pedestal 110 match. Note that the front-side pin 80 or rear-side pin 82 may abut on or may be separated from a leftward inner wall portion of the narrowed portion 140.

The worker next inserts the coupling pin 148 from the pin insertion hole 146. By a tip of the coupling pin 148 entering the pin hole, the sliding plate 112 is positioned and fixed on the pedestal 110. After that (or before that), the worker further rotates the cock handles 100 approximately 90°, and sets the female joints 98 and the male joints 102 to a locked state. As a result, the restraining jig 64 is firmly restrained by (coupled to) the upper ends of the first arm member 90 and the second arm member 92, via the second rotary locks.

Figure 10:
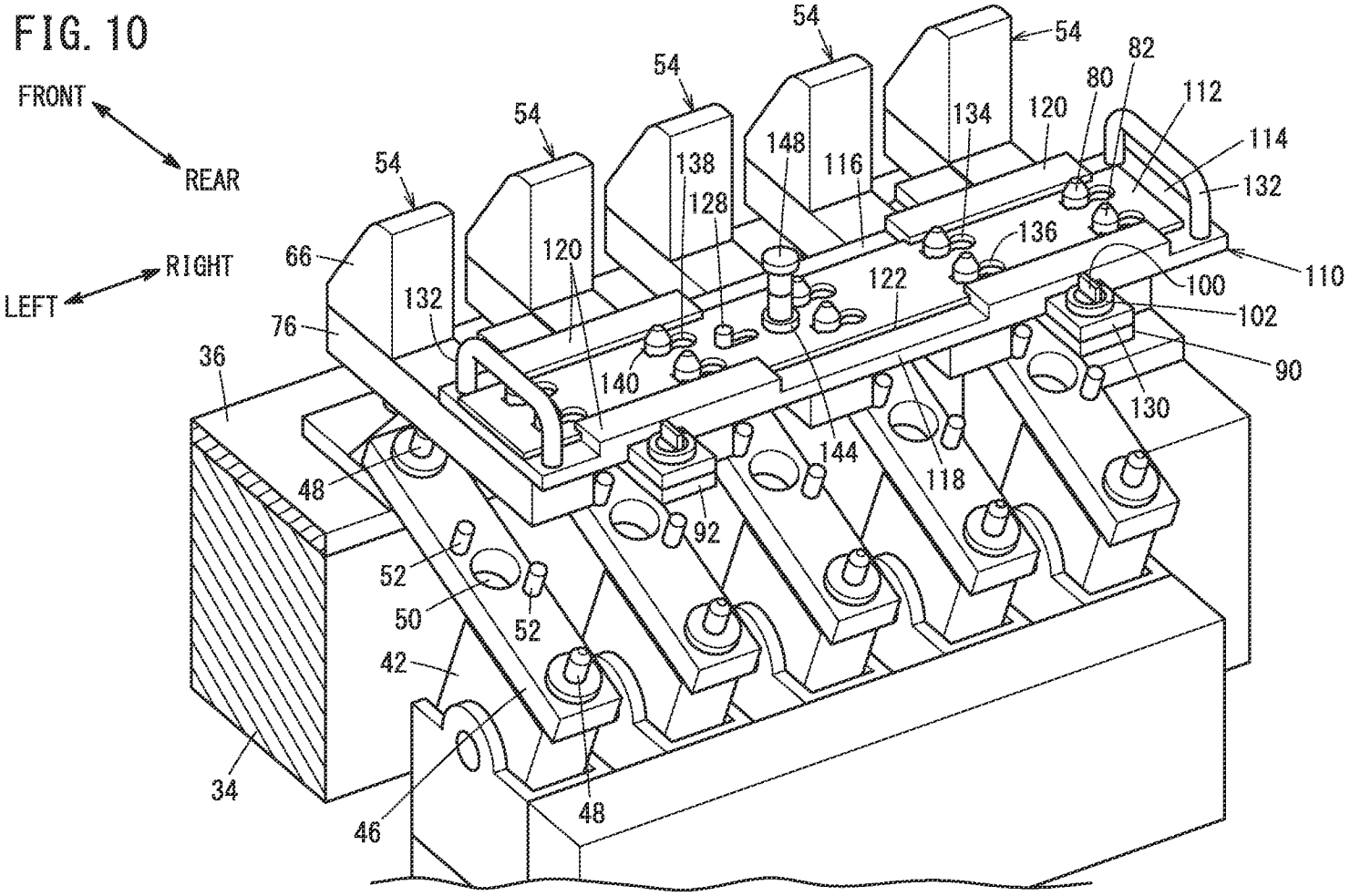
FIG. 10 is a principal parts perspective view showing a state where raising/lowering rods configuring the actuators have been lowered, following from FIG. 8.

The worker next stops actuation of the second pallet clamps 48. As a result, locking of the second pallet clamps 48 to the second embedding blocks 72 is released. Due to this release, the seating bodies 54 are released from restraint of the raising/lowering rods 44 via the placing blocks 46. In this state, all of the raising/lowering cylinders 42 are synchronously energized, and, as shown in FIG. 10, all of the raising/lowering rods 44 simultaneously descend. As described above, since the seating bodies 54 are restrained by the restraining jig 64, and released from restraint of the raising/lowering rods 44, it is avoided that the seating bodies 54 descend integrally with the raising/lowering rods 44. That is, the seating bodies 54 withdraw from the raising/lowering rods 44 or the placing blocks 46.

The worker next stops actuation of the first pallet clamps 38. Locking of the first pallet clamps 38 to the first embedding blocks 40 is thereby released, and, as a result, the holding board 36 is released from restraint of the base 34. In this state, the holding board 36 is conveyed, integrally with the first arm member 90, the second arm member 92, and the restraining jig 64, by a conveying mechanism such as a conveying robot (refer to FIG. 2). That is, the holding board 36 withdraws from the base 34. Since the seating bodies 54 are restrained by the restraining jig 64, the seating bodies 54 too withdraw from the base 34 accompanied by the restraining jig 64.

Next, in a reverse order to that described above, other seating bodies 54 are fitted to the placing blocks 46. Specifically, similarly to in FIG. 2, another holding board 36 fitted with the first arm member 90 and the second arm member 92 is conveyed, integrally with the restraining jig 64 restraining the other seating bodies 54, by the conveying mechanism. At this time, all of the raising/lowering rods 44 descend similarly to in FIG. 10. Moreover, the sliding plate 112 is set to a position at which the front-side pins 80 and the rear-side pins 82 are positioned in the narrowed portions 140, and the stopper pin 128 abuts on the leftward inner wall portion of the pin insertion slit 142. Furthermore, the coupling pin 148 enters the pin hole, and the first rotary locks and the second rotary locks are all in a locked state.

After the base portion 60 of the holding board 36 has been placed on the base 34, the worker actuates the first pallet clamps 38. As a result, the first embedding blocks 40 are locked to the first pallet clamps 38, and the holding board 36 is prevented from coming away from the base 34.

In this state, the worker raises all of the raising/lowering rods 44 to the highest point. Since the placing blocks 46 ascend integrally with the raising/lowering rods 44, the second pallet clamps 48 enter the second embedding blocks 72 provided in the main body portions 66 of the seating bodies 54. As a result, a similar state to that of FIG. 8 is attained. By the second pallet clamps 48 being actuated, and the second embedding blocks 72 being locked to the second pallet clamps 48, the seating bodies 54 are prevented from coming away from the placing blocks 46. That is, the seating bodies 54 are restrained by the raising/lowering rods 44 via the placing blocks 46.

Simultaneously to the second pallet clamps 48 entering the second embedding blocks 72, the positioning pins 52 enter the positioning holes 74 (refer to FIG. 3). As a result, positional misalignment of the seating bodies 54 with respect to the placing blocks 46, is prevented.

The worker next removes the coupling pin 148 from the pin hole and the pin insertion hole 146. As a result, the sliding plate 112 is released from restraint of the coupling pin 148, and becomes able to slide along the pedestal 110. After that (or before that), the worker further rotates the cock handles 100 approximately 90°, and sets the female joints 98 and the male joints 102 to a locking-released state. As a result, the restraining jig 64 is released from restraint of the first arm member 90 and the second arm member 92 via the second rotary locks.

The worker next grips the columnar handle 144, and imparts a force moving the sliding plate 112 to the left. As a result, the sliding plate 112 slides leftwards in the sliding groove 122. Consequently, similarly to in FIG. 7, the front-side pins 80 and the rear-side pins 82 move relatively into the circular portions 138 of the front-side slits 134 and the rear-side slits 136. The sliding plate 112 stops by the stopper pin 128 abutting on a rightward inner wall portion of the pin insertion slit 142. At this time point, the front-side insertion holes 124 and the rear-side insertion holes 126 are respectively positioned immediately below the circular portions 138 of the front-side slits 134 and the rear-side slits 136.

Due to the front-side pins 80 and the rear-side pins 82 moving as described above, the front-side inner wall portions and the rear-side inner wall portions of the narrowed portions 140 withdraw from the respective engaging grooves 84 of the front-side pins 80 and the rear-side pins 82. That is, engagement of the engaging grooves 84 and the front-side inner wall portions and the rear-side inner wall portions of the narrowed portions 140, is released. Moreover, since the circular portions 138 have larger diameters than the front-side pins 80 and the rear-side pins 82, the inner wall portions of the circular portions 138 will never abut on the front-side pins 80 and the rear-side pins 82. For the above reasons, the seating bodies 54 are released from restraint of the restraining jig 64. In other words, the restraining jig 64 is in a state of being withdrawable from the seating bodies 54.

Subsequently, the worker grips the arched handles 132 to lift up the restraining jig 64. As a result, the front-side pins 80 and the rear-side pins 82 withdraw from the circular portions 138 and the front-side insertion holes 124 and the rear-side insertion holes 126 to achieve a state in which the restraining jig 64 is removed from the first arm member 90 and the second arm member 92 similarly to in FIG. 5. As described above, since the seating bodies 54 are released from restraint of the restraining jig 64, and restrained by the raising/lowering rods 44, it is avoided that the seating bodies 54 are removed integrally with the restraining jig 64. That is, the seating bodies 54 maintain a state of being restrained (held) by the raising/lowering rods 44 or the placing blocks 46.

The worker next removes the first arm member 90 and the second arm member 92 from the holding board 36. Specifically, the cock handles 94 are rotated approximately 90°, and the female joints and male joints 96 are set to a locking-released state. Then, the worker grips the first arm member 90 and the second arm member 92 to lift them up, whereby the joint portions of the male joints 96 withdraw from the female joints.

Naturally, the remaining seating bodies 54 are also exchanged for other seating bodies 54 in accordance with what has been described above. Then, sewing of the other instrument panel 20 using the other seating bodies 54 is performed similarly to as described above.

As indicated above, according to the present embodiment, it is possible for the plurality of seating bodies 54 to be collectively restrained by one restraining jig 64. Therefore, the plurality of seating bodies 54 can be simultaneously withdrawn from the raising/lowering rods 44 (or raising/lowering cylinders 42). Moreover, since restraint of the plurality of seating bodies 54 by the restraining jig 64 is collectively released, the plurality of seating bodies 54 can be simultaneously fitted to the raising/lowering rods 44 (or raising/lowering cylinders 42). That is, it is possible for the plurality of seating bodies 54 to be collectively delivered from the restraining jig 64 to the raising/lowering rods 44, or in a reverse direction to that, that is, from the raising/lowering rods 44 to the restraining jig 64.

Thus, in the present embodiment, the plurality of seating bodies 54 can be collectively exchanged. Hence, there is no need for work individually exchanging the individual seating bodies 54 to be performed. Therefore, exchange work is simplified, and the burden of the worker decreases. Moreover, since the seating bodies 54 can be exchanged in a short time, a suspension time of sewing work shortens. Hence, it can be avoided that sewing efficiency falls.

Moreover, as may be understood from what has been described above, in the present embodiment, the base 34 is configured as a universal portion, and the holding board 36 (and the seating bodies 54) are configured as dedicated portions suited to the vehicle type. Moreover, a configuration is adopted to handle change of vehicle type by exchanging the dedicated portions after removing them from the base 34. Therefore, there is no particular need for a plurality of bases 34 to be prepared. Accordingly, a reduction in plant investment can be achieved.

The present invention is not specifically limited to the above-described embodiment, and a variety of alterations are possible in a range not departing from the spirit of the present invention.

For example, the seating body 54 may have a suction hole formed in the main body portion 66 thereof.

Moreover, a configuration may be adopted whereby a lubricating plate for facilitating sliding of the sliding plate 112 is inserted between the bottom surface of the sliding groove 122 and the sliding plate 112.

Furthermore, it goes without saying that the object-to-be-sewn is not limited to the instrument panel 20.

What is claimed is:

1. A sewing device that forms a seam in an object-to-be-sewn by a needle configured to penetrate through or withdraw from the object-to-be-sewn due to repeating reciprocating movement, and a looper that faces the needle with the object-to-be-sewn therebetween and is housed within a post bed, the sewing device comprising:

a plurality of actuators;

a plurality of seating bodies provided in an attachable/detachable manner to the individual actuators, and configured to seat on or separate from certain regions of the object-to-be-sewn; and a restraining jig configured to collectively restrain the plurality of seating bodies, and collectively release restraint of the plurality of seating bodies, wherein due to the restraining jig collectively restraining the plurality of seating bodies provided to the actuators, the plurality of seating bodies are allowed to withdraw from the actuators as the actuators operate in a direction of separating from the object-to-be-sewn, and when the restraining jig collectively releases restraint of the plurality of seating bodies, the seating bodies become displaceable as the actuators operate in a direction of seating on or separating from the object-to-be-sewn.

2. The sewing device according to claim 1, further comprising:

a base portion;

a support whose one end is provided in an attachable/detachable manner to the base portion; and a first attaching/detaching mechanism configured to allow the support to be restrained to the base portion or released from restraint to the base portion, wherein the restraining jig is supported by another end of the support, and the another end of the support is provided with a second attaching/detaching mechanism configured to allow the restraining jig to be restrained or released from restraint.

3. The sewing device according to claim 2, wherein the sewing device includes a base, and the base and the base portion are provided with a pallet clamp.

4. The sewing device according to claim 2, wherein the restraining jig includes:

a pedestal that extends so as to overlap certain regions of the plurality of seating bodies, and is positioned and fixed on the support by being restrained by the second attaching/detaching mechanism; and a sliding member configured to slide on the pedestal along an extension direction of the pedestal, the seating bodies are provided with first engaging portions, and the sliding member is provided with second engaging portions in a number corresponding to a total number of the first engaging portions of the seating bodies to be restrained, and as the sliding member slides on the pedestal, the first engaging portions and the second engaging portions engage with each other, or engagement of the first engaging portions and the second engaging portions is released.

5. The sewing device according to claim 4, wherein the certain regions of the plurality of seating bodies are provided with projections, the pedestal includes insertion holes through which the projections are inserted, the sliding member includes notches which extend along the extension direction of the pedestal, and through which the projections are inserted, the first engaging portion is a groove formed in a side surface of each of the projections, the second engaging portion is an inner wall portion of each of the notches, and the inner wall portion enters or withdraws from the groove, with sliding of the sliding member.

6. The sewing device according to claim 5, wherein the notch includes a through-hole portion penetrating with a dimension allowing the projection to enter or withdraw therefrom, and, when the projection is positioned in the through-hole portion, the inner wall portion withdraws from the groove to release restraint for the seating body.

7. The sewing device according to claim 4, wherein the sliding member is provided with a gripping portion.

8. The sewing device according to claim 1, wherein the seating body and the actuator are provided with a pallet clamp.

9. The sewing device according to claim 1, wherein one of the actuator and the seating body is provided with a protrusion, and another of the seating body and the actuator is provided with a recess, the protrusion entering or withdrawing from the recess.

* * * * *